US006846224B2

(12) United States Patent
Ki

(10) Patent No.: US 6,846,224 B2
(45) Date of Patent: Jan. 25, 2005

(54) SURFACE PLANARIZATION EQUIPMENT FOR USE IN THE MANUFACTURING OF SEMICONDUCTOR DEVICES

(75) Inventor: Soo-Jin Ki, Hwasung-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 53 days.

(21) Appl. No.: 10/440,087

(22) Filed: May 19, 2003

(65) Prior Publication Data

US 2003/0232581 A1 Dec. 18, 2003

(30) Foreign Application Priority Data

Jul. 16, 2002 (KR) ..... 10-2002-0041756

(51) Int. Cl.[7] ..... B24B 49/00; B24B 51/00

(52) U.S. Cl. ..... 451/9; 451/67; 451/278; 451/332; 451/339; 451/388

(58) Field of Search ..... 451/5, 8, 9, 10, 451/11, 41, 54, 59, 63, 67, 278, 331, 332, 333, 335, 339, 388

(56) References Cited

U.S. PATENT DOCUMENTS 4,667,445 A * 5/1987 Kimura ..... 451/285
6,077,153 A * 6/2000 Fujita et al. ..... 451/259
6,165,056 A * 12/2000 Hayashi et al. ..... 451/281
RE37,622 E * 4/2002 Karlsrud et al. ..... 451/11
6,379,230 B1 * 4/2002 Hayashi et al. ..... 451/292
2002/0115392 A1 * 8/2002 Kawashima ..... 451/289
2003/0166380 A1 * 9/2003 Shibuki ..... 451/41

* cited by examiner

*Primary Examiner*—Timothy V. Eley
(74) *Attorney, Agent, or Firm*—Volentine Francos & Whitt, P.L.L.C.

(57) ABSTRACT

Surface planarization equipment of a semiconductor wafer safely transfers wafers to an unloading cassette. In addition to the unloading cassette, the surface planarization equipment includes a loading cassette configured to hold wafers awaiting surface planarization, an index table including a plurality of first rotary vacuum wafer chucks that receive wafers from the loading cassette, at least one grinding head disposed above the index table and operative to perform a planarization process on the wafers supported by the chucks, a cleaning and drying unit including a second wafer rotary vacuum chuck receiving the wafers from the index table after the planarization process is completed and from which the cleaned and dried wafers are transferred to the unloading cassette. A position detector includes one or more sensors disposed beside respective ones of the vacuum chucks to stop the chucks at desired positions. Accordingly, the wafers supported on the chucks will be oriented properly for insertion into the unloading cassette.

17 Claims, 5 Drawing Sheets

SURFACE PLANARIZATION EQUIPMENT FOR USE IN THE MANUFACTURING OF SEMICONDUCTOR DEVICES

BACKGROUND OF THE INVENTION

1. Field of the Invention

The present invention relates to the planarizing of a surface of wafer in the manufacturing of a semiconductor device. More particularly, the present invention relates to chemical mechanical polishing apparatus for polishing the surface of wafer.

2. Description of the Related Art

Generally, semiconductor devices are becoming more highly integrated and the distance between adjacent cell regions is constantly being reduced. Accordingly, the surface configuration of the semiconductor wafer is becoming more complicated such that height differences at the wafer surface are becoming more pronounced. Therefore, a broken wire or a short circuit can be produced more easily during manufacture, especially during a multi-stacked process. Therefore, planarization technology is required to reduce the height differences at the surface of the wafer and thereby make it less likely that defects will be produced during the manufacturing of wiring on the surface. In this respect, a chemical mechanical polishing (CMP) process is widely used as the planarization technique. The CMP process uses an abrasive solution (slurry) to eliminate the height difference(s) on the surface of the wafer.

More particularly, conventional CMP equipment comprises a head for supporting the wafer and a table onto which the slurry is dispensed. The wafer is adhered to the head, and a grinding pad is attached to the table. The slurry is supplied between the head and the table, and the head and the table are rotated independently of each other to grind the wafer.

Another type of CMP equipment that is widely used comprises an index table including a plurality of wafer chucks. The index table is divided into multiple areas, such as four areas. The wafer chucks hold respective wafers using a vacuum and rotate at a high speed. The four areas comprise a loading station, a first grinding station at which a rough grinding process is performed, a second grinding station at which a final grinding process is performed, and an unloading station, respectively. The index table is rotated in a predetermined direction to bring the wafer chuck into position with the respective stations in succession, whereby the wafer held by the chuck is subjected to a predetermined grinding process.

To this end, a first and a second grinding head are provided above the first and the second grinding stations of the index table, respectively. The first and second grinding heads can be moved up and down and rotated to perform a grinding process on each wafer disposed at the respective grinding station.

Furthermore, a cleaning and drying unit is disposed to one side of the index table to clean and dry wafers transferred thereto from the unloading station after the grinding process is completed. The cleaning and drying unit also includes a wafer chuck having an upper surface to which a wafer can be secured by a vacuum. This wafer chuck is also rotated in a predetermined direction.

However, recently, the wafers that are being subjected to the CMP process are thinner and larger in diameter than ever before. Accordingly, the wafers tend to warp, especially at the outer peripheral edge portions. A wafer that is warped may not be smoothly inserted into the slot of a cassette when the wafer is unloaded from the CMP equipment. That is, the wafer can be bumped into the cassette and become damaged or broken after the CMP process is completed.

SUMMARY OF THE INVENTION

An object of the present invention is to overcome one or more of the above-described problems of the prior art.

More specifically, an object of the present invention is to provide surface planarization equipment in which all of the wafers transferred to a particular rotary wafer vacuum chuck will be oriented in the same relative position, e.g., a position in which the flat zone of the wafer will face an opening of an unloading cassette just before the wafer is transferred through the opening and into the cassette.

Another object of the present invention is to provide surface planarization equipment in which any warping at the edge of the wafer will not undermine the ability of the equipment to safely insert the wafer into an unloading cassette.

According to one aspect of the present invention, the surface planarization equipment includes a first wafer cassette, an index table having a plurality of rotary vacuum wafer chucks that are indexed to a loading station to receive wafers from the first cassette, at least one grinding head disposed above the index table for planarizing wafers supported on the rotary vacuum wafer chucks, a second wafer cassette disposed downstream of an unloading station of the index table so as to receive the wafers after the wafers are planarized by the grinding head, and a position detector operative to stop the rotation of the wafer chucks when the wafer chucks reach a predetermined relative position after the wafers supported thereon have been planarized by the grinding head.

The position detector includes position sensors operatively associated with the rotary vacuum wafer chucks, respectively, and a controller. The sensors sense when the chucks have been rotated to a predetermined relative position.

The controller is operatively connected to the sensors, the drive motors of the wafer chucks, and the grinding head. The controller receives a signal from the grinding head indicative of the termination of the planarization of a wafer by the head. The controller then stops the rotation of the wafer chucks when the first wafer chucks reach a predetermined relative position.

According to another aspect of the present invention, a wafer cleaning and drying unit is interposed between the index table, at the downstream side thereof, and the second wafer cassette so as to receive wafers from the index table after the wafers are planarized by the grinding head. The cleaning and drying unit includes a second rotary vacuum wafer chuck.

In this case, the position detector includes a position sensor operatively associated with the second rotary vacuum wafer chuck, i.e., the rotary vacuum chuck of the cleaning and drying unit. The controller is operatively connected to the cleaning and drying unit to stop the rotation of the wafer chuck thereof when the chuck reaches a predetermined relative position after the wafer supported thereon has been cleaned and dried.

Preferably, the body of each of the rotary vacuum wafer chucks has a truncated cylindrical outer surface including a flat portion such that the shape of the body corresponds to that of a wafer having a flat zone. Each position sensor is a photosensor or proximity sensor that senses the flat portion of the outer surface of a respective wafer chuck.

According to still another aspect of the present invention, an unloading transfer unit is interposed between the index table, at the downstream side thereof, and the second wafer cassette. The transfer unit is dedicated to transfer wafers to the second cassette after the wafers are planarized and/or cleaned and dried. The unloading transfer unit includes a longitudinally extending unloading arm having a plurality of vacuum holes in an outer surface thereof, and a vacuum line to which the vacuum holes are connected. The vacuum holes are spaced longitudinally along the arm such that a wafer transferred by the arm is adhered thereto at locations along the outer peripheral edge of the wafer.

BRIEF DESCRIPTION OF THE DRAWINGS

The above and other objects, features and advantages of the present invention will become better understood from the following detailed description of the preferred embodiments thereof made in conjunction with the accompanying drawings, in which like reference numerals denote like parts, and in which.

DETAILED DESCRIPTION OF THE PREFFERED EMBODIMENTS

Reference will now be made in detail to the preferred embodiments of the surface planarization equipment according to the present invention.

Figure 1:
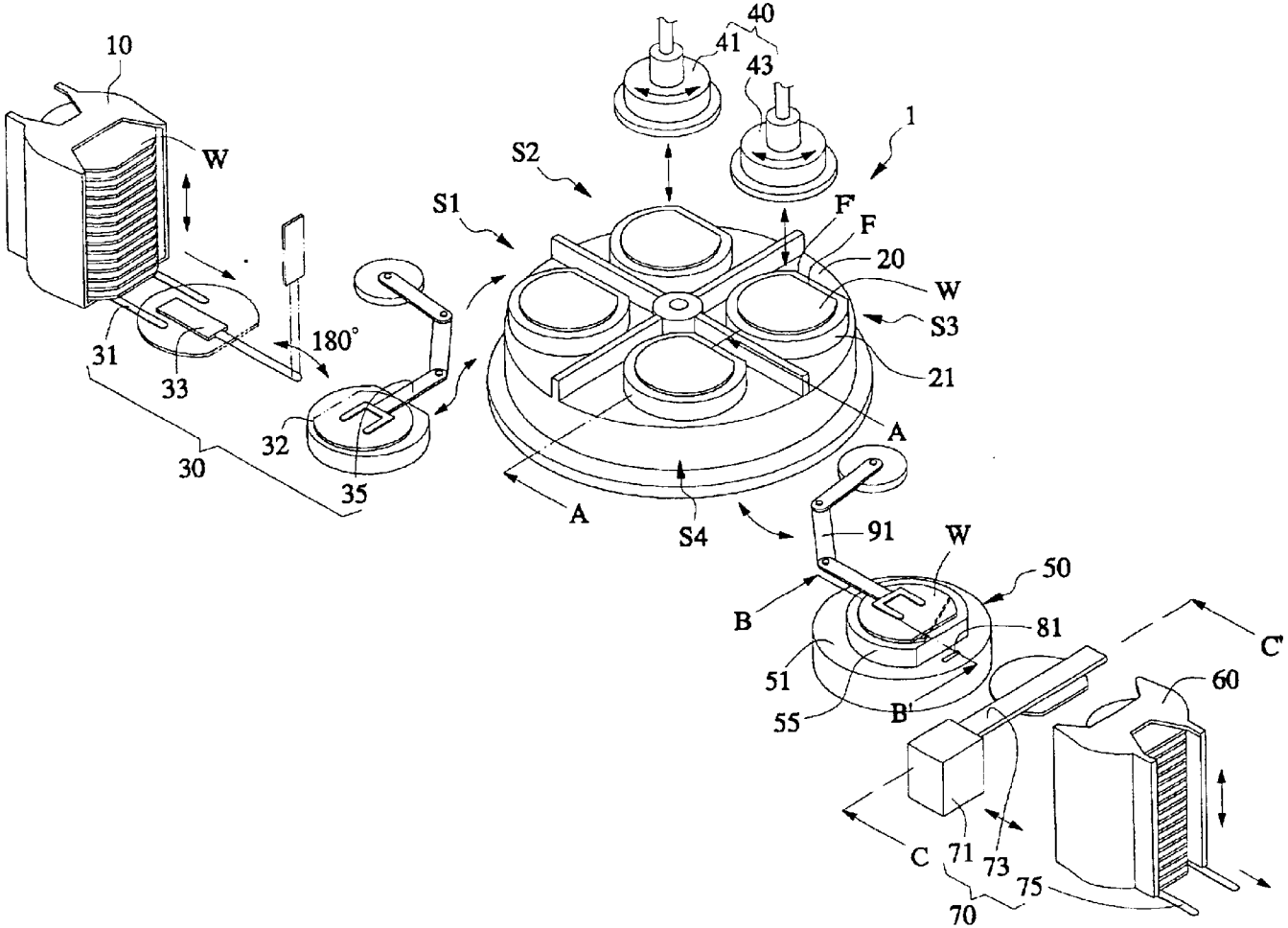
FIG. 1 is a perspective view of surface planarization equipment according to the present invention.
Figure 2:
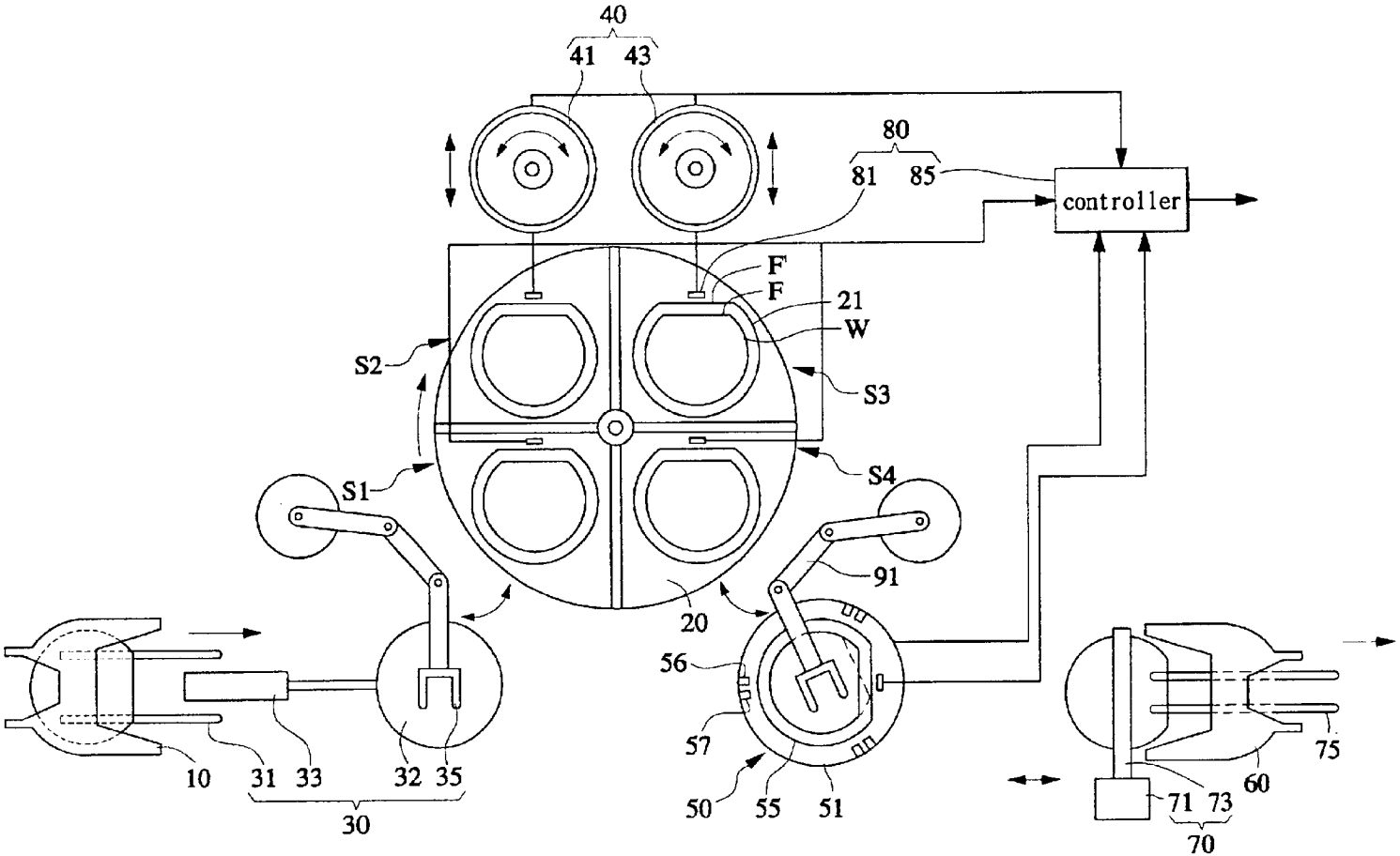
FIG. 2 is a plan view of the surface planarization equipment according to the present invention.

As shown in FIG. 1 and FIG. 2, the surface planarization equipment 1 comprises a loading cassette 10, an index table comprising a rotary turntable 20, a wafer supply unit 30, a grinding unit 40, a cleaning and drying unit 50, an unloading cassette 60, and an unloading transfer device 70. The wafer supply unit 30 loads a wafer from the loading cassette 10 onto the index table 20. On the other hand, the unloading transfer device 70 unloads a wafer from the cleaning and drying unit 50 and transfers the wafer to the unloading cassette 60.

The index table provides for a loading station S1, a first grinding station S2, a second grinding station S3 and an unloading station S4, wherein each station occupies a fan-shaped area subtending an angle of 90 degrees. In other words, the stations S1–S4 all have the same size.

The wafer is taken in at the loading station S1, and the wafer is taken off of the index table at the unloading station S4 after the grinding process is completed. A surface planarization process, i.e., a grinding process, is performed on the wafer at the first grinding station S2. A final grinding process is performed on the wafer at the second grinding station S3.

Figure 3:
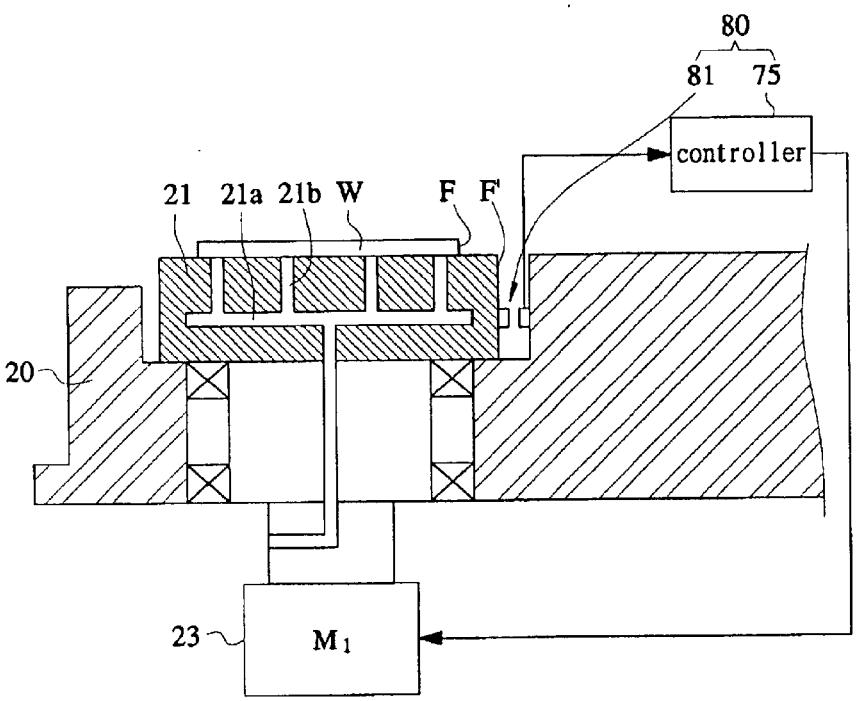
FIG. 3 is a cross-sectional view taken along line A–A' of FIG. 1.

As shown in FIG. 1 to FIG. 3, vacuum holes 21*b* connected with a vacuum line 21*a* serve to fix a wafer by suction on the upper surface of the turntable 20 at each station S1 to S4. More specifically, the index table includes first rotary vacuum wafer chucks 21, and a first driving motor 23 for rotating the chucks 21 at each respective station S1–S4. The driving motor 23 rotates the first wafer chucks 21 at a high speed and in a predetermined direction. The rotary turntable of the index table 20, on the other hand, is rotated in predetermined increments by a motor (not shown) so that the wafer loaded onto the table at the loading station S1 is transferred to the stations S2 to S4 in succession, whereby the wafer is subjected to a grinding process.

The wafer supply unit 30 comprises a first conveyer 31, a wafer pre-loader 32, a transfer arm 33, and a first robot arm 35. An elevator (not shown) moves the loading cassette 10 downward to position the lowermost wafer in the cassette 10 atop the first conveyor 31. The first conveyer 31 moves horizontally in the direction of the arrow → to extract the lowermost wafer from the loading cassette 10. The transfer arm 33 transfers the wafer to the wafer pre-loader 32. The first transfer arm 35 picks up the wafer from the wafer pre-loader 32, and transfers the wafer to the loading station S1 of the index table 20.

The grinding unit 40 includes a first grinding head 41 and a second grinding head 43. The grinding unit 40 moves vertically and horizontally to position the first and the second grinding heads 41 and 43 over upper surfaces of the wafers loaded on the first wafer chucks 21 at the second and third stations S2 and S3, respectively. There, the first and the second grinding heads 41 and 43 are rotated in the same direction as or in a direction opposite to that of the direction of rotation of the wafer chucks 21, whereby the wafers are polished. A second robot transfer arm 91 transfers a wafer from the unloading station S4 of the index table to the cleaning and drying unit 50.

Figure 4:
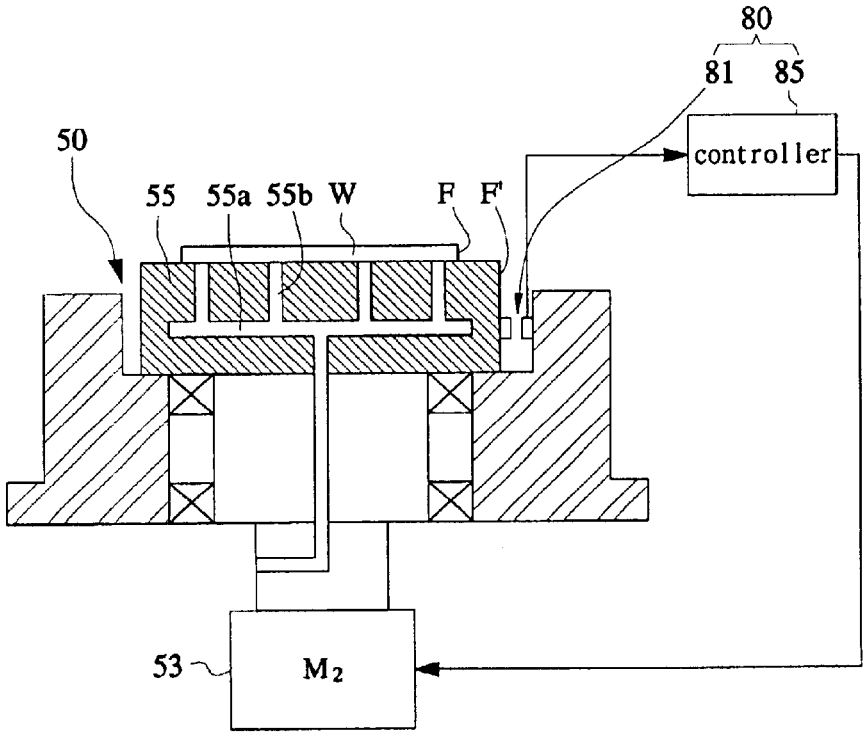
FIG. 4 is a cross-sectional view taken along line B–B' of FIG. 1.

As shown in FIG. 1, FIG. 2 and FIG. 4, the cleaning and drying unit 50 includes a cleaning and drying chamber 51, a second rotary vacuum wafer chuck 55 disposed inside of the chamber 51, and a second driving motor 53 that rotates the second wafer chuck 55. As shown in FIG. 4, the second wafer chuck 55 has the same configuration as the first wafer chuck 21, i.e., multiple vacuum holes 55*b* connected with a vacuum line 55*a*, such that a wafer can be fixed to the upper surface of the second wafer chuck 55 using a vacuum.

Also, an air nozzle 56 and a water nozzle 57 are installed in the top of the cleaning and drying chamber 51. The water nozzle 57 sprays a stream of water onto the second wafer chuck 55 to clean particles and other chemical components from the surface of the wafer. The air nozzle 56 sprays a stream of air onto the wafer to dry the wafer.

As shown in FIG. 2, FIG. 3, and FIG. 4, the first and the second wafer chucks 21 and 55 are stopped at a fixed position by a position detector unit 80. The position detector unit 80 includes a detector 81 and a controller 85. The detector 81 detects for a predetermined part of the edge of the wafer, such as a flat zone F of the wafer, loaded on the chuck 21 or 55. The controller 85 is also connected to the grinding unit 40 so as to receive a signal therefrom indicating that the first and second grinding heads 41 and 43 have been raised above the index table 20. Also, the controller 85 is connected to the cleaning and drying unit 50 so as to receive a signal therefrom indicating that the cleaning and drying process has started. The controller 85 is programmed to set the number of rotations of the first and second wafer chucks 21 and 55, and to output a signal that stops the first and the second driving motors 23 and 53 once the set numbers of rotations are detected by the respective detectors 81.

Preferably, the detector 81 is a proximity switch or a photo sensor. When the detector 81 is to detect for the flat zone F of the wafer, the sensing of the actual flat zone F of the wafer is potentially problematic if the wafer is particularly thin. Therefore, according to the present invention, the body of each wafer chuck 21, 55 has a truncated cylindrical outer shape, i.e., has a flat portion or zone F' corresponding to the flat zone of the wafer. That is, the cross-sectional shape of each wafer chuck 21 and 55 is the same as that of a wafer. The detector 81 is thus oriented to detect the flat zone F' of the wafer chuck 21, 55. The detector 81 can detect the flat zone F' of the wafer chuck 21, 55 with more reliability than it could the flat zone F of the wafer because the flat zone F' of the wafer chuck 21, 55 is much thicker than the flat zone F of the wafer. It is to be noted, in this respect, that the flat zones F of the wafers are aligned with the flat zones F' of the first and the second wafer chucks 21 and 55 the flat zone F when the wafers are loaded on the wafer chucks 21 and 55.

Figure 5:
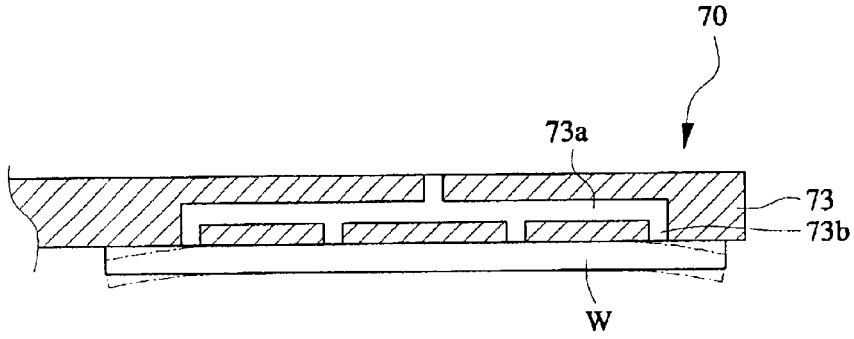
FIG. 5 is a cross-sectional view taken along line C–C' of FIG. 1.

The unloading transfer device 70 transfers the wafer from the cleaning and drying unit 50 to the unloading cassette 60 after the drying process is completed. As shown in FIG. 5, the unloading transfer device includes an unloading arm 73 in the form of a bar. The surface of the unloading arm 73 contacting the wafer has multiple vacuum holes 73*b* connected with a vacuum line 73*a*. Numerous ones of the vacuum holes 73*b* are located at positions corresponding to the outer peripheral edge of a wafer, so that a severely warped area of the wafer will be flexed and thereby held flat against the surface of the unloading arm 73.

As shown in FIG. 1 and FIG. 2, the unloading transfer device 70 also includes a mobile block 71, connected with the unloading arm 73, and movable horizontally. On the other hand, the unloading cassette 60 is movable up and down by an elevator. A second conveyer 75 extends horizontally to the bottom of the unloading cassette 60. Therefore, when a wafer is transferred from the unloading arm 73 to the unloading cassette 60, the second conveyer 75 is moved in the direction of the arrow → to transfer the wafer to the inside of the unloading cassette 60.

The operation of the surface planarization equipment of the present invention will now be described in more detail.

First, the loading cassette 10 is moved downwardly by the elevator (not shown), whereby the lowermost wafer in the cassette 10 is loaded onto the upper surface of the first conveyer 31. Then the first conveyer 31 is driven in the direction of the arrow → to transfer the wafer onto the upper surface of the transfer arm 33. The transfer arm 33 secures the wafer thereto using a vacuum. Once the wafer is loaded on the transfer arm 33, the transfer arm 33 rotates in a vertical plane over an angle of 180 degrees to transfer the wafer to the upper surface of the wafer pre-loader 32.

Next, the first robot transfer arm 35 transfers the wafer on the wafer pre-loader 32 to the loading station S1 of the index table. Subsequently, the turntable 20 is rotated in the clockwise direction shown in FIG. 2 to transfer the wafer to the first grinding station S2. At this time, the first grinding head 41 is moved downwardly and is rotated. Meanwhile, the first wafer chuck 21 placed at the first grinding station S2 is also rotated in the same or opposite direction. Accordingly, the wafer held to the first wafer chuck 21 is subjected to a first grinding process.

After the first grinding process is completed, the turntable 20 is rotated again to transfer the wafer chuck 21 to the second grinding station S3. The second grinding head 43 is moved downwardly and is rotated to subject the wafer to a second grinding process, similar to the first grinding process. After the second grinding process is completed, the turntable 20 is rotated again to transfer the wafer chuck 21 to the unloading station S4. Note, the wafer supply unit 30 continuously supplies wafers to the loading station S1 while the turntable 20 is indexed to bring the wafers through the sequence described above.

The second transfer arm 91 then transfers the wafers from the unloading station S4 to the upper surface of the second wafer chuck 55 of the cleaning and drying unit 50. The second wafer chuck 55 rotates at a predetermined speed while the water nozzle 57 of the unit 50 sprays a stream of water onto the wafer to eliminate particles and chemical material adhering to the surface of the wafer. Subsequently, the air nozzle 56 of the unit 50 sprays a stream of air to dry the wafer.

After the cleaning and drying process is completed, the unloading transfer device 70 transfers the wafer to the unloading cassette 60. More specifically, the mobile block 71 moves horizontally in the direction of the arrow ↔, whereby the unloading arm 73 is positioned over the top of the wafer situated on the upper surface of the second wafer chuck 55. The unloading arm 73 secures the wafer thereto using the vacuum holes 73*b* connected with the vacuum line 73*a*. Then the mobile block 71 moves backward in the direction of the arrow ↔, and thereby inserts the wafer into the unloading cassette 60, i.e., places the wafer in a predetermined position or designated slot in the unloading cassette 60.

At this time, the wafer is held flat by the unloading arm 73 even if the wafer is warped because the vacuum holes 73*b* are located in a high density at positions aligned with the outer peripheral edge of the wafer, namely that part of the wafer that will be most severely warped. Therefore, the unloading arm 73 inserts the wafer into the designated slot of the unloading cassette 60 smoothly. That is, the wafer is not bumped into the unloading cassette 60 as it is being inserted into the cassette 60. Once the wafer is placed in its proper position within the opening of the unloading cassette 60, the second conveyer 75 is moved in the direction of the arrow → to transfer the wafer fully into the unloading cassette 60.

As the result of any grinding process performed on the wafer, the wafer flat zone F of the wafer will be less warped than any other portion of the edge of the wafer. Therefore, the present invention ensures that the flat zone F of the wafer is the leading edge that is first inserted into the unloading cassette 60. To this end, as shown in FIG. 1 and FIG. 2, the flat zone F of the wafer loaded on the second wafer chuck 55 of the cleaning and drying unit 50 performing is oriented to face the opening of the unloading cassette 60. The position detector 80 is used to orient the wafer in this way.

The reason why the wafer needs to be oriented in the first place, such that the flat zone F of the wafer will face the opening of the unloading cassette 60, is as follows. The thickness of the ground wafer is measured continuously during the grinding processes carried out at the first and second grinding stations S2 and S3. Once the desired thickness of the wafer is attained, the first and the second grinding head 41 and 43 are moved upwardly off of the wafers, and the rotation of the first wafer chucks 21 is terminated. However, the time that it takes to grind the wafers is different because the thicknesses of the wafers are different. Therefore, the positions at which the first wafer chucks 21 are stopped after the grinding processes are carried out on respective wafers differ due to the various original thicknesses of the wafers.

In other words, even though the wafers sequentially supplied to the loading station S1 are always oriented in the same relative position, the first wafer chuck 21 is stopped at different positions in the first grinding station S2 at the end of the initial grinding processes. The same holds true for the wafer chuck 21 at the second grinding station S3. That is, the wafers may be stopped at different positions before reaching the unloading station S4, i.e., their orientations are basically at random when they arrive at the unloading station.

Thus, the wafer may be disposed at a corresponding random orientation, for example, the orientation shown by the dotted line of FIG. 2, when the second transfer arm 91 transfers the wafer to the second wafer chuck 55 of the cleaning and drying unit 50. If left this way, the orientation of the wafers would remain random at the end of the cleaning and drying process because the second wafer chuck 55 of the cleaning and drying unit 50 rotates the wafer any number of times in carrying out the process.

However, according to the present invention, the position detector 80 is used to ensure that the wafers are all oriented in the same direction before being inserted in the unloading cassette 70. The wafer chuck 21 is rotated as the first and second grinding heads 41 and 43 are moved up after the grinding process is completed. The detector 80 starts to count the number of rotations of the first wafer chuck 21 at this time, i.e., beginning from when the first and the second grinding heads 41 and 43 are moved upwardly after the grinding process is completed. Once a preset number of rotations of the first wafer chuck 21 are detected, the controller 85 outputs a stop signal to the first driving motor 23 to stop the first wafer chuck 21 in a predetermined position, e.g. with the face F'of the body of the wafer chuck facing the sensor 81 of the detector as shown in FIG. 3.

Therefore, the wafers are always oriented the same at the unloading station S4, as shown in FIG. 1 and FIG. 2, e.g., with the flat zones F of the wafers facing in the same direction with respect to the downstream processing unit (the cleaning and drying unit 50 in this case). Note, the stopped position of the first wafer chuck 21 is not limited to the position shown in FIG. 1 and FIG. 2, but will depend on the particular configuration the surface planarization equipment.

The principle of operation of the detector 80 in connection with the second wafer chuck 55 is the same as that described above in connection with the first wafer chuck 21. In other words, once the controller 85 detects that the drying process has been completed, the second wafer chuck 55 is rotated a preset number of times whereupon the controller 85 outputs a signal that stops the second driving motor 53 at such a time that the wafer is set in a predetermined relative position (FIG. 4).

As described above, surface planarization equipment of the present invention includes a plurality of wafer rotary vacuum chucks, and a position detector that senses that positions of the wafer chucks and stops the wafer chucks so that the wafers are all oriented at the same relative rotational position. Therefore, the flat zone of each of the wafers, i.e., the area of the wafer that tends to be the least warped, is always inserted first into the unloading cassette. Accordingly, the wafers are prevented from being bumped or broken during the wafer unloading process.

In addition, the unloading arm of the wafer transfer unit secures the wafer thereto with a vacuum exerted at the peripheral edge of the wafer. Therefore, the wafer is held flat against the arm, so as to exhibit less warping. Accordingly, it is easier to insert the wafer in this state into the unloading cassette.

Finally, although the present invention has been particularly shown and described with reference to the preferred embodiments thereof, it will be understood by those skilled in the art that various changes in form and details may be made thereto without departing from the true spirit and scope of the invention as defined by the appended claims.

What is claimed is:

1. Surface planarization equipment for use in planarizing a semiconductor wafer, comprising:

a loading cassette configured to store a plurality of wafers awaiting surface planarization;

an index table disposed downstream of said loading cassette in the equipment so as to receive wafers from the loading cassette, said index table including a rotary turntable, a plurality of first wafer vacuum chucks supported by said turntable so as to be rotatable to relative said turntable, and a respective first driving motor operatively connected to each of said first wafer vacuum chucks so as to rotate the chucks;

at least one grinding head disposed above said index table, and supported so as to be movable up and down and so as to be rotatable to perform a grinding process on a wafer adhered to one of said first wafer vacuum chucks, whereby the wafers are planarized;

an unloading wafer cassette configured to store a plurality of the wafers and disposed downstream of said index table so as to receive the wafers after the wafers are planarized by said at least one grinding bead; and a position detector including position sensors operatively associated with said first wafer vacuum chucks, respectively, and operative to sense when each of said chucks has been rotated to a predetermined position, and a controller operatively connected to said sensors and to said first drive motors so as to stop the rotation of said first wafer vacuum chucks when the first wafer vacuum chucks reach a predetermined relative position after the wafers supported thereon have been planarized by said at least one grinding head.

2. Surface planarization equipment according to claim 1, wherein each of said first wafer vacuum chucks has a body through which a vacuum line extends, said body having an upper surface in which vacuum holes connected to said vacuum line extend, and said body having a truncated cylindrical outer surface including a flat portion, whereby the shape of said body corresponds to that of a wafer having a flat zone at its outer peripheral edge.

3. Surface planarization equipment according to claim 2, wherein said position sensor is a photosensor or a proximity sensor.

4. Surface planarization equipment according to claim 1, wherein said controller comprises a counter for counting the number of times each of said sensors senses that the wafer chuck associated therewith has been rotated to its predetermined position.

5. Surface planarization equipment according to claim 4, wherein said controller is operatively connected to said at least one grinding head so as to receive a signal therefrom indicative of the termination of the planarization of a wafer by the head.

6. Surface planarization equipment according to claim 1, and further comprising an unloading transfer unit interposed between said index table, at the downstream side thereof, and said unloading wafer cassette and dedicated to transfer wafers to said unloading cassette after the wafers are planarized by said at least one grinding head, said unloading transfer unit including a longitudinally extending unloading arm having a plurality of vacuum holes in an outer surface thereof, and a vacuum line to which said vacuum holes are connected, said vacuum holes being spaced longitudinally along said arm, whereby a wafer transferred by said arm is adhered thereto at locations along its outer peripheral edge.

7. Surface planarization equipment according to claim 1, and further comprising a wafer cleaning and drying unit interposed between said index table, at the downstream side thereof, and said unloading wafer cassette so as to receive wafers from the index table after the wafers are planarized by said at least one grinding head, said cleaning and drying unit including a second wafer vacuum chuck supported in said unit so as to be rotatable, and a second driving motor operatively connected to said second wafer vacuum chuck so as to rotate said second wafer vacuum chuck.

8. Surface planarization equipment according to claim 7, wherein said position detector also includes a position sensor operatively associated with said second wafer vacuum chuck, and operative to sense when said second wafer vacuum chuck has been rotated to a predetermined position, and wherein said controller is operatively connected to the position sensor associated with said second wafer vacuum chuck and to said second drive motor so as to stop the rotation of said second wafer vacuum chuck when the second chuck reaches a predetermined relative position after the wafer supported thereon has been cleaned and dried.

9. Surface planarization equipment according to claim 8, wherein said controller comprises a counter for counting the number of times the sensor associated with said second wafer vacuum chuck senses that the chuck has been rotated to its predetermined position.

10. Surface planarization equipment according to claim 9, wherein said controller is operatively connected to said cleaning and drying unit so as to receive a signal therefrom indicative of the initiation of a process in which a wafer supported on said second chuck is to be dried by said cleaning and drying unit.

11. Surface planarization equipment for use in planarizing a semiconductor wafer, comprising:

a loading cassette configured to store a plurality of wafers awaiting surface planarization;

an index table disposed downstream of said loading cassette in the equipment so as to receive wafers from the loading cassette, said index table including a rotary turntable, a plural of first wafer vacuum chucks supported by said turntable so as to be rotatable to relative said turntable, and a respective first driving motor operatively connected to each of said first wafer vacuum chucks so as to rotate the chucks;

at least one grinding head disposed above said index table, and supported so as to be movable up and down and so as to be rotatable to perform a grinding process on a wafer adhered to one of said first wafer vacuum chucks, whereby the wafers are planarized;

an unloading wafer cassette configured to store a plurality of the wafers and disposed downstream of said index table so as to receive the wafers after the wafers are planarized by said at least one grinding head;

a wafer cleaning and drying unit interposed between said index table, at the downstream side thereof, and said unloading wafer cassette so as to receive wafers from the index table after the wafers are planarized by said at least one grinding head, said cleaning and drying unit including a second wafer vacuum chuck supported in said unit so as to be rotatable, and a second driving motor operatively connected to said second wafer vacuum chuck so as to rotate said second wafer vacuum chuck; and a position detector including a position sensor operatively associated with said second wafer vacuum chuck, and operative to sense when said second wafer vacuum chuck has been rotated to a predetermined position, and a controller operatively connected to said position sensor and to said second drive motor so as to stop the rotation of said second wafer vacuum chuck when the second wafer vacuum chuck reaches a predetermined relative position after the wafer supported thereon has been cleaned and dried.

12. Surface planarization equipment according to claim 11, wherein each of said wafer vacuum chucks has a body through which a vacuum line extends, said body having an upper surface in which vacuum holes connected to said vacuum line extend, and said body having a truncated cylindrical outer surface including a flat portion, whereby the shape of said body corresponds to that of a wafer having a flat zone at its outer peripheral edge.

13. Surface planarization equipment according to claim 12, wherein said position sensor is a photosensor or a proximity sensor.

14. Surface planarization equipment according to claim 11, and further comprising an unloading transfer unit interposed between said cleaning and drying unit and said unloading wafer cassette and dedicated to transfer wafers to said unloading cassette after the wafers are cleaned and dried by said cleaning and drying unit, said unloading transfer unit including a longitudinally extending unloading arm having a plurality of vacuum holes in an outer surface thereof, and a vacuum line to which said vacuum holes are connected, said vacuum holes being spaced longitudinally along said arm, whereby a wafer transferred by said arm is adhered thereto at locations along its outer peripheral edge.

15. Surface planarization equipment according to claim 11, wherein said controller comprises a counter for counting the number of times said position sensor associated with said second wafer vacuum chuck senses that the second wafer vacuum chuck has been rotated to its predetermined position.

16. Surface planarization equipment according to claim 15, wherein said controller is operatively connected to said cleaning and drying unit so as to receive a signal therefrom indicative of the initiation of a process in which a wafer supported on said second wafer vacuum chuck is to be dried by said cleaning and drying unit.

17. Surface planarization equipment for use in planarizing a semiconductor wafer, comprising:

a loading cassette configured to store a plurality of wafers awaiting surface planarization;

an index table disposed downstream of said loading cassette in the equipment so as to receive wafers from the loading cassette, said index table including a rotary turntable, a plurality of first wafer vacuum chucks supported by said turntable so as to be rotatable to relative said turntable, and a respective first driving motor operatively connected to each of said first wafer vacuum chucks so as to rotate the chucks;

at least one grinding head disposed above said index table, and supported so as to be movable up and down and so as to be rotatable to perform a grinding process on a wafer adhered to one of said first wafer vacuum chucks, whereby the wafers are planarized;

an unloading wafer cassette configured to store a plurality of the wafers and disposed downstream of said index table so as to receive the wafers after the wafers are planarized by said at least one grinding head; and an unloading transfer unit interposed between said index table, at the downstream side thereof, and said unloading wafer cassette and dedicated to transfer wafers to said unloading cassette after the wafers are planarized by said at least one grinding head, said unloading transfer unit including a longitudinally extending unloading arm having a plurality of vacuum holes in an outer surface thereof, and a vacuum line to which said vacuum holes are connected, said vacuum holes being spaced longitudinally along said arm, whereby a wafer transferred by said arm is adhered thereto at locations along its outer peripheral edge.

* * * * *